US006374438B1

(12) United States Patent
Fox et al.

(10) Patent No.: US 6,374,438 B1
(45) Date of Patent: Apr. 23, 2002

(54) TREATMENT STRETCHER ADAPTED FOR C-ARM ACCESS

(75) Inventors: Michael D. Fox, Rittman; Raymond A. Failor, Seville; Daniel J. Radden, Elyria, all of OH (US)

(73) Assignee: Steris INC, Temecula, CA (US)

( * ) Notice: Subject to any disclaimer, the term of this patent is extended or adjusted under 35 U.S.C. 154(b) by 0 days.

(21) Appl. No.: 09/546,959

(22) Filed: Apr. 11, 2000

(51) Int. Cl.[7] ..... A47C 21/08
(52) U.S. Cl. ..... 5/600; 5/617; 5/618; 5/625
(58) Field of Search ..... 5/424, 425, 427, 5/430, 428, 600, 617, 618, 658, 625, 627

(56) References Cited

U.S. PATENT DOCUMENTS

| | | | | | |
|---|---|---|---|---|---|
| 4,005,497 | A | * | 2/1977 | Sutter | 5/617 |
| 4,669,136 | A | | 6/1987 | Waters et al. | |
| 4,723,808 | A | * | 2/1988 | Hines | 5/614 |
| 4,985,946 | A | | 1/1991 | Foster et al. | |
| 5,077,843 | A | | 1/1992 | Foster et al. | |
| 5,083,332 | A | | 1/1992 | Foster et al. | |
| 5,179,744 | A | | 1/1993 | Foster et al. | |
| 5,208,928 | A | | 5/1993 | Kuck et al. | |
| 5,377,370 | A | | 1/1995 | Foster et al. | |
| 5,402,543 | A | * | 4/1995 | Dietrich et al. | 5/610 |
| 5,732,423 | A | * | 3/1998 | Weismiller et al. | 5/425 |

OTHER PUBLICATIONS

TimeTable Mobile Procedures Centre for Same–Day Surgery (Nesbit Evans).
Image–Guided Surgical Tables (Stille 1997).
Beta Mobile C–Arm Procedures Table Extended Travel Model S4017 (Beta Medical Products, Inc.).
C–Arm Procedures Stretcher Model No. S 3706 (Beta Medical Products, Inc.).
Fluoro–Track Fluoroscopy Stretcher (Hausted).
Fluoroscopy (Stryker Medical) (Oct. 96).
Economy C–Arm Table/Fluoroview Imaging Tables (U.S. Imaging Tables, Inc.).
Digital Traumex (It does what no other system can do) Fisher Imaging Corp. (May 1997).
ID100 Fluoroscopic Examining Table (Image Diagnostics, Inc.) (Apr. 1996).
560 Radiology/Emergency Dept. Hydraulic C–Arm Stretcher (Midmark Corp. 1996).

* cited by examiner

*Primary Examiner*—Lynne H. Browne
*Assistant Examiner*—Fredrick Conley
(74) *Attorney, Agent, or Firm*—Fay, Sharpe, Fagan, Minnich & McKee, LLP

(57) ABSTRACT

A mobile patient stretcher is provided and particularly adapted for additional use as a pain clinic treatment table designed to accommodate a C-arm of a fluoroscopic or like imaging apparatus. The stretcher litter top or patient support surface is radiolucent and includes selectively removable lateral side rail sections so that the litter top can be selectively converted into an hourglass shape without side rails as required for treatment procedures and/or C-arm access and imaging. On the other hand, with the lateral side rail sections in place, the stretcher includes a full-width patient support surface, and also includes a radiolucent fowler back rest, selectively deployable side rails, and a hydraulically or otherwise controlled conventional wheeled stretcher base that is adapted to place the patient support surface in a raised, lowered, Trendelenburg, or reverse Trendelenburg orientation. Thus, the stretcher can be used as a fully functional stretcher to transport a patient to and from a procedure area and a recovery area, provides a comfortable resting place with a fowler back rest for a patient, and is also usable as a treatment table during fluoroscopic or other imaging procedures.

20 Claims, 5 Drawing Sheets

TREATMENT STRETCHER ADAPTED FOR C-ARM ACCESS

BACKGROUND OF THE INVENTION

The present invention relates generally to a mobile patient stretcher or trolley. More particularly, the invention relates to a full-width, fully functional patient stretcher that is particularly adapted for additional use as a pain clinic treatment table designed to accommodate a C-arm of a fluoroscopic or like imaging apparatus. The stretcher litter top or patient support surface is radiolucent and includes selectively removable lateral side rail sections so that the stretcher support surface can be selectively converted into an hourglass shape without side rails as required for treatment procedures and/or C-arm access and imaging. On the other hand, with the lateral side rail sections in place, the stretcher includes a full-width patient support surface, and also includes a radiolucent fowler back rest, selectively deployable side rails, and a hydraulically or otherwise controlled conventional wheeled stretcher base that is adapted to place the patient support surface in a raised, lowered, Trendelenburg, or reverse Trendelenburg orientation. Thus, the present invention can be used as a fully functional stretcher to transport a patient to and from a procedure area and a recovery area, provides a comfortable resting place with a fowler back rest for a patient, and is also usable as a treatment table during fluoroscopic or other imaging procedures.

Prior stretchers have been designed for C-arm access. However, none have provided the utility and safety of a fully functional, dual-pedestal stretcher in combination with a procedure table that is adapted to accommodate a C-arm. For example, some prior designs have omitted side rails altogether, and others do not allow the side rails to be raised and lowered as needed for patient safety and access. Other prior designs have not included a fowler backrest for patient comfort. To ensure C-arm access, other prior designs have reduced the width of the patient support surface over its entire length, but this approach reduces the comfort of the patient and obviously increases the risk that a patient can fall from the support surface.

In light of the foregoing, a need has been identified for a full size and fully functional stretcher that easily and conveniently converts into an hourglass shaped treatment table that accommodates a C-arm.

SUMMARY OF THE INVENTION

In accordance with the present invention, a new and improved stretcher adapted for C-arm access is provided.

In accordance with a first aspect of the present invention, the stretcher includes a litter top defined by a foot section of a first width, a head section of a second width, and a central section interconnecting said foot and head sections. The central section has a third width less than the first and second widths of the foot and head sections. Thus, the litter top defines an hourglass shaped perimeter with first and second recessed areas located on opposite lateral sides. A wheeled base supports the combined stretcher and treatment table above a support surface and includes a chassis and first and second spaced-apart and selectively extensible pedestal supports projecting upwardly from the chassis. The first and second pedestal supports are operably connected to the litter top and support same above the base. A first side rail assembly is adapted for selective connection to the litter top. The first side rail assembly includes: (i) a first gap filler panel member that is received in and substantially fills the first recessed area when the first side rail assembly is connected to the litter top; and, (ii) a first side rail that is selectively movable between an extended position projecting upwardly substantially above the litter top and a lowered position. A second side rail assembly is also provided and adapted for selective connection to the litter top. The second side rail assembly includes: (i) a second gap filler panel member that is received in and substantially fills the second recessed area when the second side rail assembly is connected to the litter top; and, (ii) a second side rail that is selectively movable between an extended position projecting upwardly substantially above the litter top and a lowered position.

One advantage of the present invention is the provision of a new and improved stretcher adapted for C-arm access.

Another advantage of the present invention resides in the provision of a fully functional stretcher that can be configured to accommodate a C-arm of a fluoroscopic imaging device during oblique and lateral imaging of a patient's spine.

A further advantage of the present invention is found in the provision of a stretcher adapted for C-arm access wherein the side rails are selective movable between raised and lowered positions, and wherein the side rails are selectively removable from the stretcher so that the patient support surface is thereby converted from a rectangular shape into an hourglass shape with the recessed portion of the hourglass shape: (i) defining at least 45%–55% of the overall length of the patient support surface; (ii) located at least substantially between the pedestals of the support base; and, (iii) positioned to correspond with the location of a patient's spine (i.e., extending at least between a patient's cervical spine region and lumbar spine region) when the patient is placed on the patient support surface in the proper orientation with his/her head located at the head-end of the stretcher.

Still another advantage of the present invention is found in the provision of a stretcher adapted for C-arm access that also includes a fowler backrest for patient comfort.

Yet another advantage of the present invention resides in the provision of a stretcher adapted for C-arm access that includes a dual-pedestal base (preferably hydraulic) for lowering the patient support surface for patient ingress/egress, raising the patient support surface for C-arm access and medical procedures, and placing the patient support surface in Trendelenburg or reverse Trendelenburg orientation.

A further advantage of the present invention resides in the provision of a stretcher adapted for C-arm access wherein the stretcher base has four wheel locking brakes and steering.

Still other benefits and advantages of the invention will become apparent to those of ordinary skill in the art upon reading and understanding the following specification.

BRIEF DESCRIPTION OF THE DRAWINGS

The invention takes form from certain components and arrangements of components, preferred embodiments of which are illustrated in the accompanying drawings that form a part hereof and wherein.

DETAILED DESCRIPTION OF PREFERRED EMBODIMENTS

Figure 1:
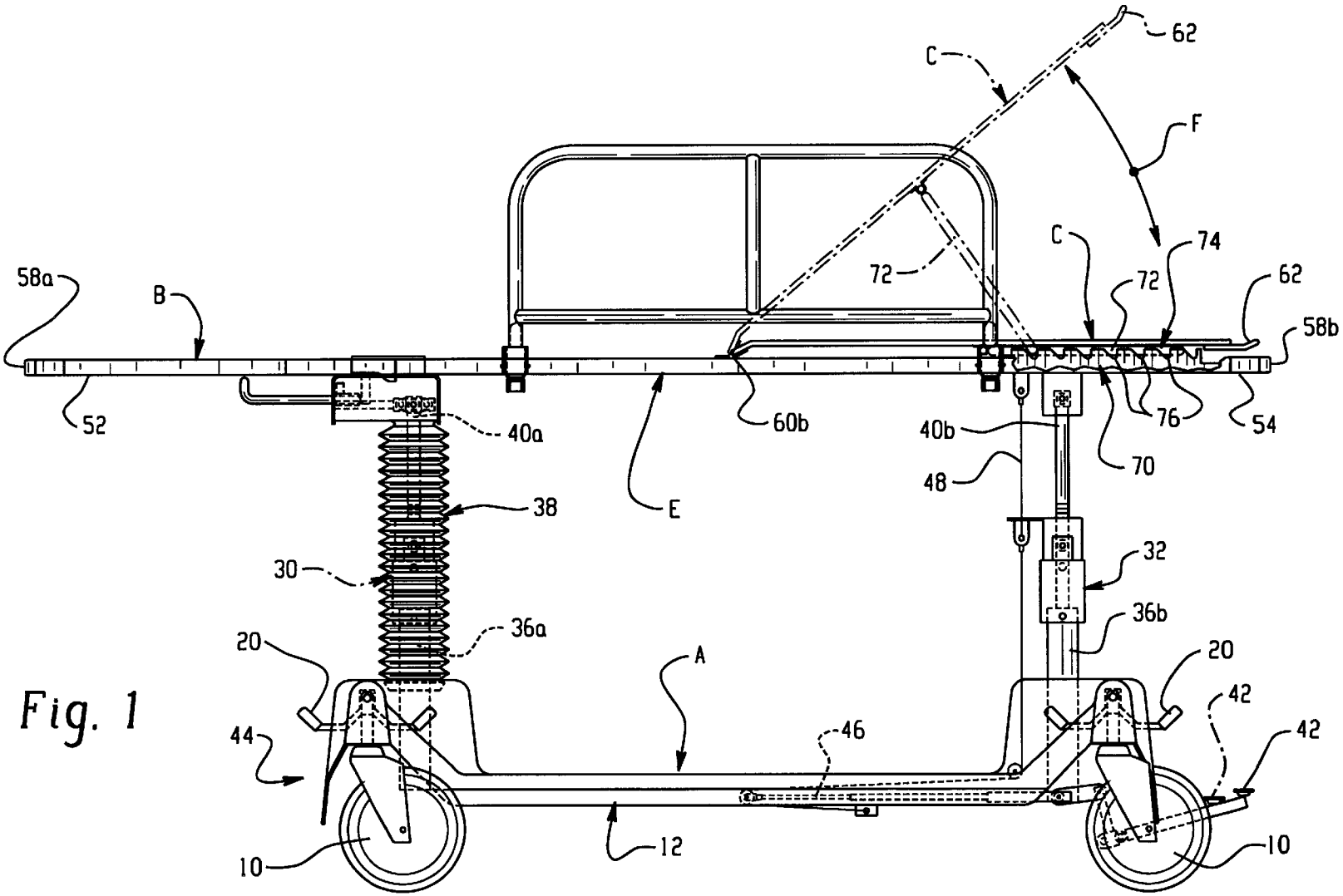
FIG. 1 is a side elevational view of a stretcher adapted for C-arm access formed in accordance with the present invention.
Figure 2:
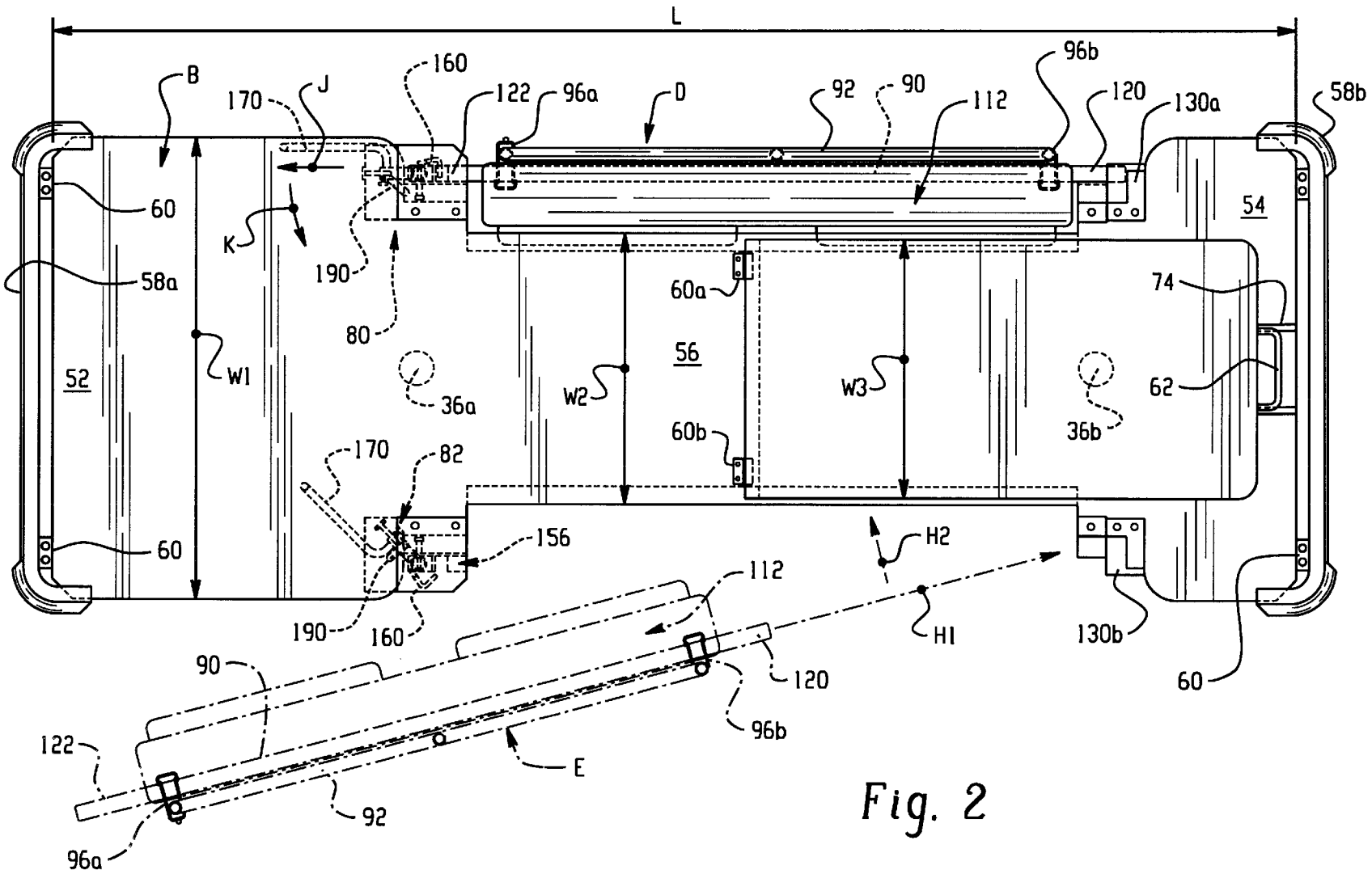
FIG. 2 is a top plan view of the stretcher shown in FIG. 1, with one of its removable side rail assembly sections attached to the stretcher and the other detached from the stretcher and illustrated in phantom lines.
Figure 3:
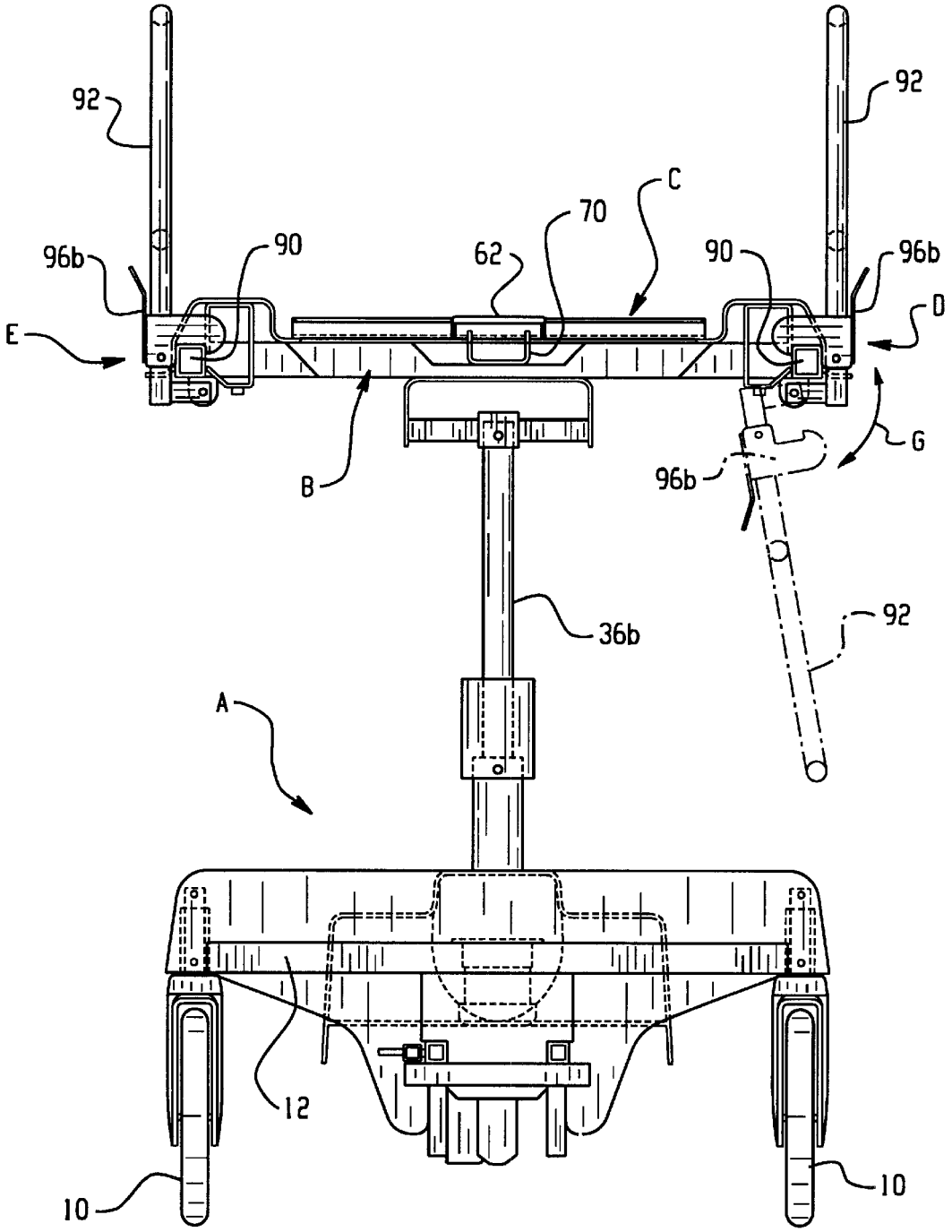
FIG. 3 is a head end elevational view of the stretcher shown in FIG. 1 illustrating pivoting movement of one of the side rails between a raised position (shown in solid lines) and a retracted or lowered position (shown in phantom lines)

Referring now to the drawings, wherein the showings are for purposes of illustrating preferred embodiments of the invention only and not for purposes of limiting same, FIGS. 1–3 illustrate a treatment stretcher adapted for C-arm access formed in accordance with the present invention. The subject stretcher is defined by five main sub-assemblies or sections: (i) base A; (ii) litter top B supported by the base; (iii) fowler backrest C pivotably connected to the litter top; (iv) a first (left) side rail assembly D adapted for releasable connection to a first (left) side of the litter top; and, (v) a second (right) side rail assembly E adapted for releasable connection to a second (right) side of the litter top.

Turning first to the base A, it is conventional in all respects and preferably comprises at least four caster wheels 10 secured to the corners of a chassis 12. The base A preferably also comprises a conventional braking/steering system including pedals 20 located adjacent each wheel. As is well known in the art, each pedal 20 is operably connected to each wheel 10 of the stretcher and can be placed in either one of three operative position—(i) a neutral position wherein each wheel is free to roll and pivot about a vertical axis; (ii) a steer position wherein each wheel is free to roll and one wheel is fixed parallel to the longitudinal axis of the base to facilitate steering of the stretcher; and, (iii) a brake position wherein at least one and preferably all of the wheels are restrained against rotation. Of course, the base A can optionally include a fifth-wheel steering system as is well known in the art, and those of ordinary skill in the art will recognize that any other suitable wheel arrangement and control system can be used without departing from the overall scope and intent of the present invention.

The base A further comprises first and second pedestals 30,32 projecting upwardly therefrom. These pedestals preferably each comprise a selectively extensible/retractable fluid cylinder such as the preferred a hydraulic cylinders 36*a*,36*b*, respectively. The cylinders 36*a*,36*b* can be encased in a flexible rubber or similar housing 38 for protection, aesthetics, and/or safety if desired as illustrated in connection with the cylinder 36*a*. An outer or distal end 40*a*,40*b* of the cylinders 36*a*,36*b*, respectively, is fixedly secured to the litter top B to support same above the base A. The base A further comprises a plurality of foot pedals 42 or other suitable convenient means by which an operator is able to control the flow of fluid into and out of one or both of the cylinders 36*a*,36*b* in a conventional manner. This, then, allows the litter top to be placed in a lowered, horizontal state (for patient ingress/egress), a raised horizontal state (for patient procedures), the Trendelenburg position, or the reverse Trendelenburg position. Here, again, those of ordinary skill in the art will recognize that the base can alternatively utilize electric motors, mechanical systems, or any other means for supporting and controlling the orientation of the litter top B.

With particular reference to FIG. 1, it should be noted that a first or foot end 52 of the litter top extends a substantial distance beyond the foot end 44 of the base A. Thus, the stretcher preferably incorporates an anti-lift system, such as a high-pressure gas cylinder 46 and associated cable restraint 48 connected to the second or head end 54 of the litter top B to prevent accidental movement of the head end 54 of the litter top upwardly away from the base A when excessive weight is placed on the foot end 52 of the litter top. This preferred anti-lift system is disclosed in full detail in commonly owned U.S. Pat. No. 5,402,543, the disclosure of which is hereby expressly incorporated by reference herein.

The litter top B is defined to have an hourglass shape as is readily apparent in FIG. 2. Specifically, the foot and head ends 52,54 of the litter top are of similar width W1, preferably approximately twenty-eight to thirty inches, and are interconnected by a central, recessed section 56 that has a constant width W2 that is less than the width of the foot and heads ends 52,54. Preferably, the central litter top section has a width W2 of approximately fifteen to eighteen inches. Of course, the width W2 is reduced relative to the width W1 so that a C-arm fluoroscope or similar imaging device can be accommodated by the central section 56 of the litter top B, i.e., the C-arm will be able to encompass the central section 56 and be adapted for rotational movement about the central section 56 without interference.

The litter top B is defined from a suitable radiolucent material. In one preferred embodiment, the litter top is defined from a carbon fiber composite material, although any other radiolucent material can be used. First and second end bumper rail assemblies 58a,58b are preferably connected to the first and second ends 52,54 of the litter top B to protect same. The bumper rail assemblies 58*a*,58*b* include or define mounting wells/ports 60 that are adapted to receive and support I.V. rods, end boards, monitor shelves, push bars, and other conventional stretcher accessories.

The litter top B, itself, preferably has a length L (not including the bumper rails 58*a*,58*b*) sufficient to accommodate adult human patients. A preferred length is approximately seventy-five to eighty-five inches. With continuing reference to FIG. 2, it is preferred that the central section 56 of the litter top B defines forty-five to fifty-five percent (most preferably approximately fifty percent) of the overall length L of the litter top B. Furthermore, it is most preferred that the foot section 52 of the litter top define at least thirty percent of the overall length L, and that the head section 54 define only ten to twenty percent of the overall length L.

From these dimensions and an examination of FIG. 2, those of ordinary skill in the art will recognize that a patient lying on the litter top with his/her head at the head end 54 will be positioned so that at least his/her entire spine will be disposed above the central, recessed portion 56 of the litter top B. Therefore, the patients entire spine region will be able to be imaged using a C-arm fluoroscope or similar C-arm imaging device. Furthermore, with reference to both FIGS. 1 and 2, it can be seen that the litter top is affixed to the cylinders 36*a*,36*b* or other pedestal structure so that the cylinders 36*a*,36*b* or other associated structure of the pedestals does not lie beneath the central section 56 of the litter top B. Thus, the pedestals 30,32 do not interfere with a C-arm of an associated imaging device without regard to the axial location of the C-arm along the length of the central top section 56.

The subject stretcher further comprises a fowler backrest C hingedly connected to the litter top B for movement between a lowered position (as shown in solid lines in FIG. 1) and one or more raised positions (as shown in broken lines in FIG. 1). The fowler backrest C is provided primarily for patient comfort during transport or other times when procedures are not being performed on the patient. The fowler backrest C is, itself, also defined from a radiolucent material, preferably carbon fiber composite, and defines a width W3 that is the same or slightly less than the width W2 as illustrated in FIG. 2. First and second hinges 60*a*,60*b* or another hinge structure is used to pivotably interconnect the fowler backrest C to the litter top B so that the fowler backrest is adapted for pivotal movement on an arc F between its raised and lowered positions. A handle 62 projects outwardly from the fowler backrest C and provides a suitable location by which an operator can grasp the fowler backrest and manually move it between its raised and lowered positions. In its lowered position, the fowler backrest is preferably spaced from the litter top B to eliminate pinch or shear points between the litter top and fowler backrest. The fowler backrest C preferably pivots relative to the litter top B at a point that will be comfortable to a patient supported on the litter top, i.e., just below the patient's pelvis. Both the exposed portion of the litter top B and fowler backrest C are preferably covered with a removal resilient mattress pad (not shown) for patient comfort and safety.

A fowler incline adjustment mechanism 70 is provided to releasably secure the fowler backrest in any desired one of its raised positions. Although pneumatic or fluid cylinders can be employed as the fowler incline adjustment mechanism as is generally well known in the art for conventional stretchers, it is most preferred that a manual, purely mechanical adjustment mechanism 70 be provided. With reference again to FIG. 1, the preferred incline adjustment mechanism comprises a strut 72 including a first end pivotably connected to the fowler backrest C and an opposite, second end. A track 74 is fixedly secured to the litter top B beneath the fowler backrest C and defines a plurality of different recesses or dwell points 76 that releasably receive and retain the second end of the strut 72. Thus, an operator uses the handle 62 to raise the fowler backrest C and places the second end of the strut 72 into one of the dwell points 76 of the track 74. The incline angle of the fowler backrest C is dependent upon which dwell point 76 holds the second end of the strut 72. It is most preferred that the fowler backrest C be positionable at a plurality of different incline angles ranging between zero and forty degrees. Most preferably, as disclosed herein, the incline adjustment mechanism is located so that it is inoperable by a patient supported on the stretcher.

The stretcher further comprises first and second side rail assemblies D,E releasably connected to the litter top B. The side rail assemblies serve a dual purpose when connected to the litter top—they fill the gaps created by the reduced width of the central section 56 of the litter top relative to the foot and head ends 52,54 of the top, and they include side rails that can be raised to protect the patient and prevent the patient from falling off of the litter top.

With reference to FIG. 2, it can be seen that each side rail assembly D,E is adapted for selective connection to the litter top B to fill the recessed areas of the top resulting from the reduced width of the central section 56. The stretcher includes first and second latch assemblies 80,82 connected to (preferably beneath) the litter top on opposite lateral sides thereof, and these latch assemblies are respectively adapted to releasably secure the first and second side rail assemblies D,E to the litter top B as is described in full detail below.

With brief reference to FIG. 3, each side rail assembly D,E includes an elongated base rail 90 and a side rail 92. The side rail 92 of each side rail assembly D,E is pivotably secured to its respective base rail 90 and adapted for pivoting movement along an arc G between a raised position as illustrated in solid lines and a lowered position as illustrated in phantom lines.

Figure 5:
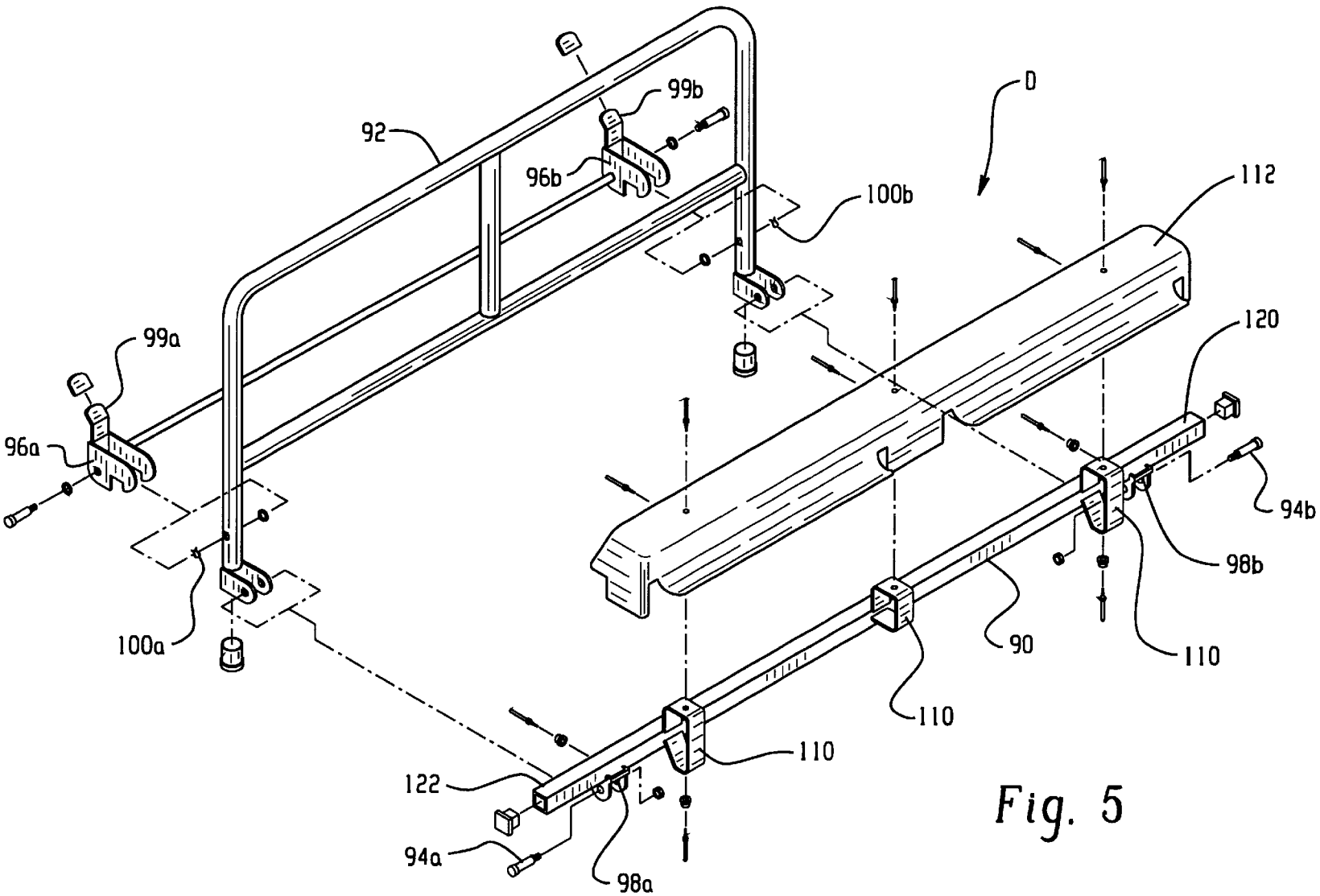

Referring now also to FIG. 5, the side rail assembly D is illustrated in further detail. The side rail assembly E is merely a mirror image. It can be seen that the side rail 92 is pivotably secured to the base rail 90 by pins 94*a*,94*b* or the like. First and second latches 96*a*,96*b* are pivotably connected to the side rail 92 and are adapted to engage respective mating portions 98*a*,98*b* of the base rail 90 when the side rail 92 is in its raised position. The first and second latches 96*a*,96*b* are spring biased into this latched condition. To release the latches 96*a*,96*b* for purposes of pivoting the side rail to its lowered position, an operator manually exerts pressure on a projecting lever portion 99*a*,99*b* of each latch so that the latches pivot against the force of their respective biasing springs 100*a*,100*b* and disengage from the mating portions 98*a*,98*b* of the side rail.

With continuing reference to FIG. 5, the side rail assembly D includes a plurality of mounting brackets 110 fixedly secured to the elongated base rail 90 at spaced intervals. To these mounting brackets a gap filler panel 112 defined from a suitable plastic, carbon fiber composite, or other material is fixedly secured by use of fasteners, adhesive, or the like. As may be seen in FIGS. 2 and 3, when the side rail assemblies D,E are connected to the litter top B, the gap filler insert panels 112 thereof respectively fill the recessed areas on opposite lateral sides of the litter top that are formed by the reduced width of the litter top central section 56 relative to the foot and head ends 52,54. This prevents loose objects, extremities of the patient, and the like from passing between the side rails 92 and the litter top B. As with the litter top B and fowler backrest C, a resilient pad can be used to cover each gap filler panel 112 for safety and comfort.

With reference again also to FIG. 2, the elongated base rail 90 of each side rail assembly D,E projects outwardly beyond the opposite axial ends of the gap filler panel 112 so that first and second opposite ends 120,122 of the rail 90 are exposed. First and second brackets 130*a*,130*b* are affixed to the underside of the litter top B adjacent the intersection of the head section 54 and the central section 56 on opposite lateral sides. These brackets 130*a*,130*b* are adapted for respectively receiving and retaining the exposed first ends 120 of the side rail assemblies D,E as indicated by the arrow H1. The side rail assemblies D,E are simultaneously moved inwardly toward the litter top B as indicated by the arrow H2. First and second rail latch assemblies 80,82 are affixed to the underside of the litter top B adjacent the intersection of the foot section 52 and central section 56 of the top B on its opposite lateral sides. These latch assemblies 80,82 are adapted to receive and releasably retain the respective exposed rail ends 122 of the side rail assemblies D,E. In FIG. 2, the latch assembly 80 is closed and is retaining the rail end 122 of the assembly D in a fixed position relative to the litter top B. On the other hand, the latch assembly 82 is open and is adapted for placement of the rail end 122 of the assembly E therein. If desired, one or both of the rail ends 120,122 can include or define a foot adapted to support the rail 90 in an upright (vertical) position on a floor or other support surface when the assembly D,E is detached from the litter top B.

Figure 4:
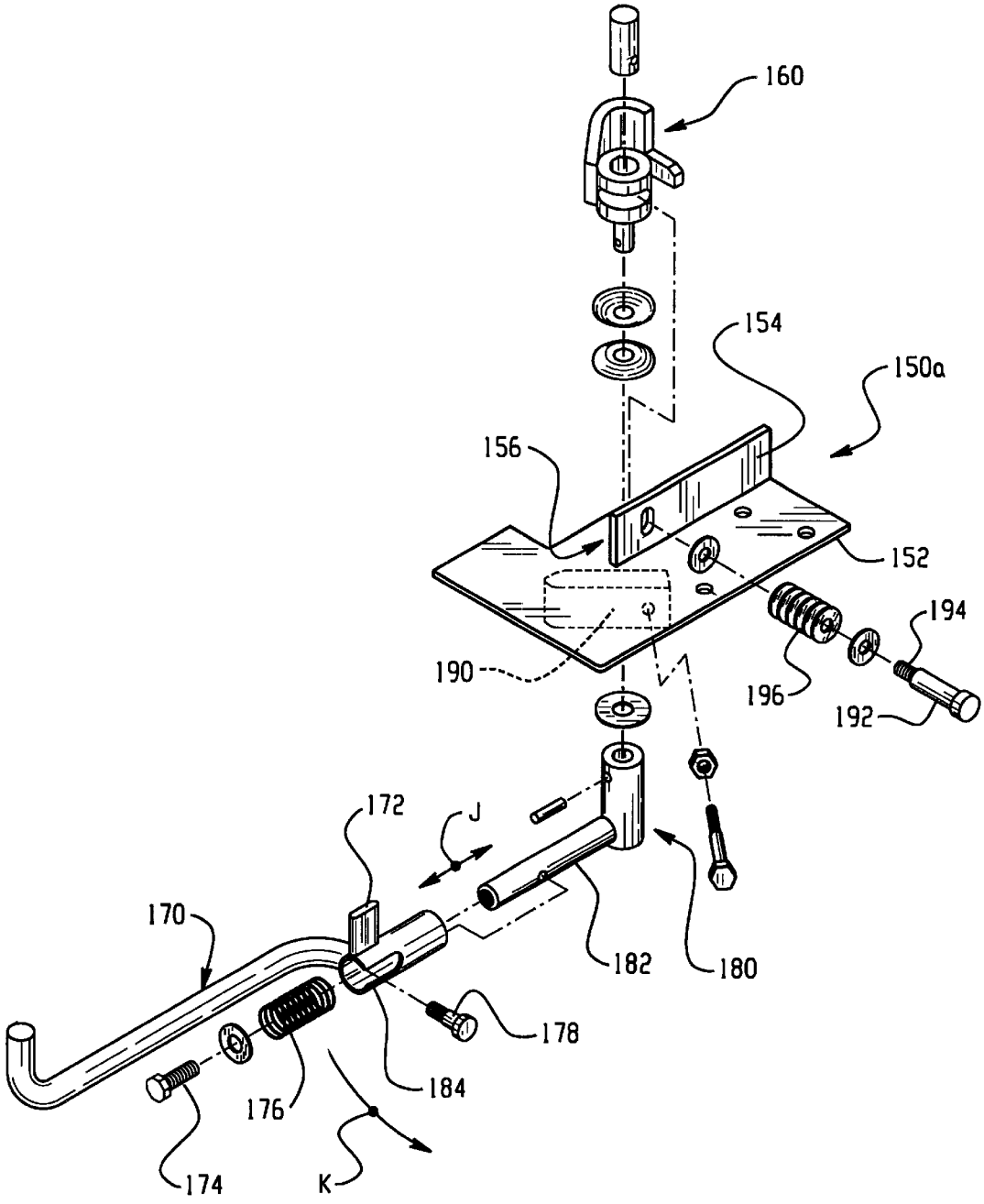
FIG. 4 is an exploded isometric view of a preferred removable rail section latch assembly; and, FIG. 5 is an exploded isometric view of a preferred removable side rail assembly formed in accordance with the present invention.

Turning now also to FIG. 4, the latch assembly 80 is illustrated (the latch assembly 82 is a mirror image). The assembly 80 includes a base plate 152 adapted for securement to the underside of the litter top B using fasteners or the like. A wall 154 projects upwardly from the base plate so that an open slot 156 is defined. This slot 156 is adapted to receive the exposed rail end 122 of the associated side rail assembly D. A cam member 160 is rotatably secured to the base plate 152 adjacent the slot 156. The cam member 160 is adapted for rotation between an open position (see FIG. 2, latch member 82) wherein the cam member allows insertion/removal of the rail end 122 relative to the slot 156, and a closed position (see FIG. 2, latch member 80) wherein the cam member engages a rail end 122 placed in the slot and prevents its removal.

Each latch assembly 80,82 includes a handle member 170 operably connected to the cam member 160 so that an operator is able to move the cam member between its opened and closed positions by simply pivoting the handle 170. A preferred arrangement is illustrated in FIG. 4 and comprises a link member 180 connected to rotate with the cam member 160 and including a projecting shank 182 to which the handle 170 is secured. A stop block 190 projects outwardly from the base plate 152 and is positioned to engage a tab 172 projecting from the handle 170 so as to prevent pivoting movement of the handle 170 as required to rotate the cam member 160 to its opened position. However, the handle 170 is slidably secured to the shank 182 and is, thus, adapted for linear movement along the shank as indicated by the arrow J. A spring 176 secured by a screw 174 biases the handle into a first, retracted position where the tab 172 cannot move past the stop block 190. However, an operator can axially extend the handle 170 by manual force so that the handle is able to pivot freely past the stop block 190 as indicated by the arrow K. A set-screw or pin 178 projects from the shank 182 of the link member 180 and is slidably received in a slot 184 defined in the handle 170. The set-screw 178 thus secures the handle to the shank 182 and limits axial extension of the handle 170 away from the stop block 190. A tensioner screw 192 is preferably threadably secured to the wall 154 and includes a distal end 194 adapted to engage the cam member 160 in a frictional fashion. A spring 196 is used to tension the screw 194 and hold same in a select position so that the tip 194 exerts a select force on the cam member 160 as desired and prevents free, uncontrolled movement thereof.

The invention has been described with reference to preferred embodiments. Of course, modifications and alterations will occur to others upon a reading and understanding the preceding specification. It is intended that the invention be construed as including all such modifications and alterations insofar as they are encompassed by the appended claims and equivalents thereof.

Having thus described the preferred embodiments, the invention is claimed to be:

1. A combined stretcher and treatment table comprising:

a litter top defined by a foot section having a first width, a head section having a second width, and a central section interconnecting said foot and head sections, said central section having a third width less than said respective first and second widths of said foot and head sections whereby said litter top defines an hourglass shaped perimeter with first and second recessed areas located on opposite lateral sides of said litter top;

a wheeled base for supporting said combined stretcher and treatment table above a support surface, said wheeled base including a chassis and first and second spaced-apart and selectively extensible pedestal supports projecting upwardly from said chassis, said first and second pedestal supports operably connected to said litter top and supporting said litter top above said base;

a first side rail assembly adapted for selective connection to said litter top, said first side rail assembly including: (i) a first gap filler panel member that is received in and substantially fills said first recessed area when said first side rail assembly is connected to said litter top; and, (ii) a first side rail that is selectively movable between an extended position projecting upwardly substantially above said litter top and a lowered position; and, a second side rail assembly adapted for selective connection to said litter top, said second side rail assembly including: (i) a second gap filler panel member that is received in and substantially fills said second recessed area when said second side rail assembly is connected to said litter top; and, (ii) a second side rail that is selectively movable between an extended position projecting upwardly substantially above said litter top and a lowered position.

2. The combined stretcher and treatment table as set forth in claim 1, wherein said foot section, said head section, and said central section of said litter top define said litter top to have an overall length, and wherein said central section of said litter top defines at least forty-five percent of said litter top overall length.

3. The combined stretcher and treatment table as set forth in claim 2, wherein said foot section of said litter top defines a greater portion of said litter top overall length than said head section.

4. The combined stretcher and treatment table as set forth in claim 2, wherein said litter top overall length is at least seventy-five inches.

5. The combined stretcher and treatment table as set forth in claim 4, wherein said respective first and second widths of said foot and head sections of said litter top are the same and at least twenty eight inches, and wherein said third width of said central section is not more than twenty inches.

6. The combined stretcher and treatment table as set forth in claim 1, wherein said first and second pedestal supports of said base are connected respectively adjacent said foot section and said head section of said litter top whereby an area between said central section of said litter top and said base is unobstructed by either of said first and second pedestal supports.

7. The combined stretcher and treatment table as set forth in claim 1, further comprising:

a fowler backrest adapted for being selectively pivoted relative to said litter top between a lowered position substantially parallel to said litter top and at least one raised position wherein said fowler backrest is fixed in an inclined position relative to said litter top.

8. The combined stretcher and treatment table as set forth in claim 7, wherein both said litter top and said fowler backrest are defined from a radiolucent material.

9. The combined stretcher and treatment table as set forth in claim 7, further comprising:

a plurality of mounting wells defined in members connected to said litter top, said mounting wells adapted for receiving and retaining accessories including at least one of I.V. rods, end boards, monitor shelves, and push bars.

10. The combined stretcher and treatment table as set forth in claim 1, further comprising:

first and second latches connected to said litter top on said opposite first and second lateral sides, respectively, said first and second latches adapted for selectively engaging and fixedly retaining said respective first and second side rail assemblies relative to said litter top.

11. The combined stretcher and treatment table as set forth in claim 1, wherein said litter top is defined from a radiolucent material.

12. The combined stretcher and treatment table as set forth in claim 1, wherein said respective first and second side rails of said first and second side rail assemblies are pivotably movable about and axis parallel to a longitudinal axis of said litter top between said extended and retracted positions when connected to said litter top.

13. The combined stretcher and treatment table as set forth in claim 12, wherein said first side rail assembly further comprises:

at least one first latch connected to said first side rail and movable between first and second positions, said at least one first latch adapted for releasably engaging a mating portion of said first side rail assembly when in its first position so as to releasably secure said first side rail in its extended position, and wherein said second side rail assembly further comprises:

at least one second latch connected to said second side rail and movable between first and second positions, said at least one second latch adapted for releasably engaging a mating portion of said second side rail assembly when in its first position so as to releasably secure said second side rail in its extended position.

14. The combined stretcher and treatment table as set forth in claim 13, wherein said at least one first latch and said at least one second latch are spring-biased into their respective first positions.

15. The combined stretcher and treatment table as set forth in claim 1, wherein said wheeled base comprises:

a plurality of caster wheels; and, a braking and steering system for placing said plurality of caster wheels in one of: (i) a neutral mode wherein all of said caster wheels are free to roll on a support surface and pivot about a vertical axis; (ii) a steer mode wherein at least one of said caster wheels is restrained against pivoting about a vertical axis; and, (iii) a brake mode wherein at least two of said caster wheels are restrained against rolling on said support surface.

16. The combined stretcher and treatment table as set forth in claim 15, wherein said first and second pedestal supports respectively comprise first and second fluid cylinders, wherein said combined stretcher and treatment table further comprises:

a plurality of foot pedals for controlling the flow of pressurized fluid into and out of said first and second fluid cylinders whereby said pedestal supports are adapted for supporting said litter top in one of: (i) a lowered substantially horizontal position; (ii) a raised substantially horizontal position; (iii) a Trendelenburg position; and (iv) a reverse Trendelenburg position.

17. A combined stretcher and treatment table comprising:

a litter top defined by a foot section having a first width, a head section having a second width, and a central section interconnecting said foot and head sections, said central section having a third width less than said respective first and second widths of said foot and head sections whereby said litter top defines an hourglass shaped perimeter with first and second recessed areas located on opposite lateral sides of said litter top;

a wheeled base for supporting said combined stretcher and treatment table above a support surface, said wheeled base including a chassis and first and second spaced-apart and selectively extensible pedestal supports projecting upwardly from said chassis, said first and second pedestal supports operably connected to said litter top and supporting said litter top above said base;

a first side rail assembly adapted for selective connection to said litter top, said first side rail assembly including: (i) a first gap filler panel member that is received in and substantially fills said first recessed area when said first side rail assembly is connected to said litter top; and, (ii) a first side rail that is selectively movable between an extended position projecting upwardly substantially above said litter top and a lowered position; and, a second side rail assembly adapted for selective connection to said litter top, said second side rail assembly including: (i) a second gap filler panel member that is received in and substantially fills said second recessed area when said second side rail assembly is connected to said litter top; and, (ii) a second side rail that is selectively movable between an extended position projecting upwardly substantially above said litter top and a lowered position, wherein:

said foot section, said head section, and said central section of said litter top define said litter top to have an overall length;

said central section of said litter top defines at least forty-five percent of said litter top overall length; and, said foot section defines at least thirty percent of the overall length of said litter top.

18. A combined stretcher and treatment table comprising:

a litter top defined by a foot section having a first width, a head section having a second width, and a central section interconnecting said foot and head sections, said central section having a third width less than said respective first and second widths of said foot and head sections whereby said litter top defines an hourglass shaped perimeter with first and second recessed areas located on opposite lateral sides of said litter top;

a base for supporting said combined stretcher and treatment table above a support surface, said base including a chassis and first and second spaced-apart and selectively extensible fluid cylinders projecting upwardly from said chassis, said first and second fluid cylinders operably connected to said litter top and supporting said litter top above said base;

a plurality of foot pedals for controlling the flow of pressurized fluid into and out of said first and second fluid cylinders whereby said pedestal supports are adapted for supporting said litter top in one of: (i) a lowered substantially horizontal position; (ii) a raised substantially horizontal position; (iii) a Trendelenburg position; and (iv) a reverse Trendelenburg position;

a plurality of caster wheels connected to said chassis;

a braking and steering system connected to said chassis for placing said plurality of caster wheels in one of: (i) a neutral mode wherein all of said caster wheels are free to roll on a support surface and pivot about a vertical axis; (ii) a steer mode wherein at least one of said caster wheels is restrained against pivoting about a vertical axis; and, (iii) a brake mode wherein at least two of said caster wheels are restrained against rolling on said support surface;

a first side rail assembly adapted for selective connection to said litter top, said first side rail assembly including: (i) a first gap filler panel member that is received in and substantially fills said first recessed area when said first side rail assembly is connected to said litter top; and, (ii) a first side rail that is selectively movable between an extended position projecting upwardly substantially above said litter top and a lowered position; and, a second side rail assembly adapted for selective connection to said litter top, said second side rail assembly including: (i) a second gap filler panel member that is received in and substantially fills said second recessed area when said second side rail assembly is connected to said litter top; and, (ii) a second side rail that is selectively movable between an extended position projecting upwardly substantially above said litter top and a lowered position;

a fowler backrest adapted for being selectively pivoted relative to said litter top between a lowered position substantially parallel to said litter top and at least one raised position wherein said fowler backrest is fixed in an inclined position relative to said litter top; and, a track defining a plurality of dwell points connected to one of said litter top and said fowler backrest; and, a strut having a first end pivotably connected to the other of said litter top, and an opposite second end adapted for releasable receipt in one of said dwell points of said track when said fowler backrest is inclined relative to said litter top so that, when said second end of said strut is located in one of said track dwell points, said strut supports said fowler backrest in an inclined position relative to said litter top.

19. A combined stretcher and treatment table comprising:

a litter top defined by a foot section having a first width, a head section having a second width, and a central section interconnecting said foot and head sections, said central section having a third width less than said respective first and second widths of said foot and head sections whereby said litter top defines an hourglass shaped perimeter with first and second recessed areas located on opposite lateral sides of said litter top;

a wheeled base for supporting said combined stretcher and treatment table above a support surface, said wheeled base including a chassis and first and second spaced-apart and selectively extensible pedestal supports projecting upwardly from said chassis, said first and second pedestal supports operably connected to said litter top and supporting said litter top above said base;

a first side rail assembly adapted for selective connection to said litter top, said first side rail assembly including: (i) a first gap filler panel member that is received in and substantially fills said first recessed area when said first side rail assembly is connected to said litter top; and, (ii) a first side rail that is selectively movable between an extended position projecting upwardly substantially above said litter top and a lowered position; and, a second side rail assembly adapted for selective connection to said litter top, said second side rail assembly including: (i) a second gap filler panel member that is received in and substantially fills said second recessed area when said second side rail assembly is connected to said litter top; and, (ii) a second side rail that is selectively movable between an extended position projecting upwardly substantially above said litter top and a lowered position;

first and second latches connected to said litter top on said opposite first and second lateral sides, respectively, said first and second latches adapted for selectively engaging and fixedly retaining said respective first and second side rail assemblies relative to said litter top, wherein first and second latches each comprise:

a base member defining a slot for receiving a projecting portion of said side rail assembly;

a cam member located adjacent said slot and movable between a first position wherein said slot is unobstructed by said cam member and a second position wherein said cam member obstructs said slot and prevents removal from said slot of said projecting portion of said side rail assembly; and, a handle member operably connected to said cam member, said handle member adapted for manual movement by an operator of said combined stretcher and treatment table between first and second operative positions corresponding respectively to said first and second operative positions of said cam member.

20. The combined stretcher and treatment table as set forth in claim 19, wherein said first and second latches each further comprise:

a link member interconnecting said handle and said cam member, wherein said handle is slidably connected to said link member and adapted for movement between a retracted and an extended position;

a stop block located to prevent movement of said handle from its second position to its first position when said handle is in one of its retracted and extended positions; and, a spring for normally biasing said handle into said one of said extended and retracted positions.

* * * * *